US009193556B2

(12) United States Patent
Tobishima

(10) Patent No.: US 9,193,556 B2
(45) Date of Patent: Nov. 24, 2015

(54) SHEET FOLDING APPARATUS AND IMAGE FORMING SYSTEM

(71) Applicant: Toshiaki Tobishima, Ebina (JP)

(72) Inventor: Toshiaki Tobishima, Ebina (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/254,444

(22) Filed: Apr. 16, 2014

(65) Prior Publication Data

US 2014/0336030 A1 Nov. 13, 2014

(30) Foreign Application Priority Data

May 8, 2013 (JP) ..... 2013-098827

(51) Int. Cl.

| | |
|---|---|
| ***B65H 45/14*** | (2006.01) |
| ***B65H 20/28*** | (2006.01) |
| ***B65H 45/20*** | (2006.01) |
| ***B65H 45/12*** | (2006.01) |

(52) U.S. Cl.

CPC ..... *B65H 45/14* (2013.01); *B65H 20/28* (2013.01); *B65H 45/12* (2013.01); *B65H 45/20* (2013.01); *B65H 2801/27* (2013.01)

(58) Field of Classification Search

CPC ..... B65H 20/28; B65H 45/14; B65H 45/20
USPC ..... 270/32, 39.01; 493/416, 419, 421, 442
See application file for complete search history.

(56) References Cited

U.S. PATENT DOCUMENTS

| | | | | |
|---|---|---|---|---|
| 5,551,939 | A * | 9/1996 | Deckers | 493/442 |
| 6,247,691 | B1 * | 6/2001 | Drago et al. | 270/45 |
| 6,436,024 | B1 * | 8/2002 | Kobayashi | 493/405 |
| 6,719,680 | B2 * | 4/2004 | Hosoya et al. | 493/324 |
| 7,470,227 | B2 * | 12/2008 | Sekine et al. | 493/434 |
| 7,503,886 | B2 * | 3/2009 | Sekine et al. | 493/434 |
| 7,802,778 | B2 * | 9/2010 | Kurita | 270/39.01 |
| 2013/0244848 | A1 | 9/2013 | Tobishima | |

FOREIGN PATENT DOCUMENTS

| | | |
|---|---|---|
| JP | 05-238635 | 9/1993 |
| JP | 11-349218 | 12/1999 |
| JP | 2004-067266 | 3/2004 |
| JP | 2006-335500 | 12/2006 |

* cited by examiner

*Primary Examiner* — Leslie A Nicholson, III
(74) *Attorney, Agent, or Firm* — Oblon, McClelland, Maier & Neustadt, L.L.P.

(57) ABSTRACT

A sheet folding apparatus including a conveying roller pair, first and second folding roller pairs, and a control unit. The control unit controls the apparatus such that a sheet conveying speed or a sheet conveying amount of the conveying roller pair is different from a sheet conveying speed or a sheet conveying amount of the first folding roller pair or the second folding roller pair when the folded part of the folded sheet is guided between the first folding roller pair and the second folding roller pair.

8 Claims, 21 Drawing Sheets

SHEET FOLDING APPARATUS AND IMAGE FORMING SYSTEM

CROSS-REFERENCE TO RELATED APPLICATIONS

The present patent application is based on and claims priority pursuant to 35 U.S.C. §119 from Japanese Patent Application No. 2013-098827, filed on May 8, 2013, in the Japan Patent Office, which is incorporated by reference herein in its entirety.

TECHNICAL FIELD

The present application generally relates to a sheet folding apparatus and an image forming system. Particularly, this application relates to a sheet folding apparatus which is used for a post-processing apparatus, for example, of a body of an image forming system such as a printing machine. Examples of printing machines include a copying machine, a printer, a facsimile apparatus, a plotter, an inkjet recording apparatus, a stencil printing apparatus, or a multi-functional machine having two or more functions thereof. This application further relates to an image forming system having mounted thereon a sheet folding apparatus.

BACKGROUND ART

In general, in an image forming apparatus capable of copying onto a large-sized sheet, such as A0, A1, etc., if such a large-sized sheet is stored as it is or if the large-sized sheet is handled as it is, the storage space required is large, or handling is inconvenient, and as such, normally, the sheet is folded for storing and handling.

However, if a sheet folding operation is performed manually, a significant amount of time is needed, so that a time required for folding a sheet may end up being longer than a time required for copying.

In light of the above, there is a system in which is arranged, in a sheet discharge path of an image forming apparatus, a sheet folding apparatus which can fold a sheet automatically, making it possible to automatically fold in succession large-sized sheets copied, as is discussed generally in JP 5-238635, JP 11-349218, JP 2004-67266, and JP 2006-335500.

In a sheet folding apparatus for use in such a system, there may be included a unit (an off-line operation) for folding a sheet which was inadvertently copied and discharged without folding in advance, or a large-sized sheet which was produced by a different image forming apparatus, as well as (an on-line operation of) automatically folding a sheet discharged from an image forming apparatus.

When paper folding is actually performed by such a system, for a standard-sized sheet such as A0, A1, etc., paper folding can be performed using a predetermined size for each face of a sheet to be folded. In an image forming apparatus capable of copying onto the large-sized sheet, copying may be performed onto a long sheet such that a length in a sub-scanning direction amounts to several meters, so that it is required to perform paper folding even for such a non-standard long sheet.

A paper folding apparatus disclosed in JP 5-238635 automatically adjusts a folded length of each folded portion to fold even a sheet other than one having a standard length to a specified dimension.

JP 11-349218 discloses a paper folding method and a paper folding mechanism that orderly form a folding edge in a desired folding mode.

JP 2004-67266 discloses a paper folding machine which ensures that unnecessary folds are not produced when a folded sheet is discharged.

JP 2006-335500 discloses a paper folding apparatus which reduces unevenness in a folding dimension even for a large-sized sheet having a curled tip.

FIG. 23 is a schematic diagram showing an operation of a related-art sheet folding apparatus. In FIG. 23, the sheet folding apparatus 1 includes a conveying roller pair 3; a first folding roller pair 6 and a second folding roller pair 7 that are arranged in an opposing manner to the left and the right of a lower portion thereof; a first sheet guiding member 4 and a second sheet guiding member 5 that selectively guide a sheet P conveyed from the conveying roller pair 3 in each folding roller pair direction; and a lower sheet face guide 10 which guides a lower face of the sheet P. The sheet P is fed by the conveying roller pair 3 and conveyed, and selectively guided to the first folding roller pair 6 or the second folding roller pair 7 by an operation of the first sheet guiding member 4 or the second sheet guiding member 5. The guided sheet P is folded a predetermined number of times by being fed between the first folding roller pair 6 or the second folding roller pair 7 while sliding on an upper face of the lower sheet face guide 10. This is accomplished by an operation of the first sheet guiding member 4 or the second sheet guiding member 5 in alignment with repetition of forward and reverse rotations of the first folding roller pair 6 and the second folding roller pair 7.

A first sensor 8 is arranged downstream of the first folding roller pair 6 in the sheet conveyance direction. The first sensor 8 senses the front end of the sheet folded by the first folding roller pair 6. A second sensor 9 is arranged downstream of the second folding roller pair 7 in the sheet conveyance direction. The second sensor 9 senses the front end of the sheet folded by the second folding roller pair 7. In FIG. 23, a number 2 denotes an inlet sensor.

Another known folding method is one in which crest folding is repeated. A folding finishing state shown in FIG. 24A is a state in which an A0-sized sheet is folded, resulting in basic folding. In this case, crest folding is performed twice with a title column facing up. Moreover, in a similar manner, with respect to A0-sized bag folding, crest folding is performed twice with the title column facing up. This folding, which cannot be handled by the related-art sheet folding apparatus, is handled by performing crest folding and trough folding from the title column side as shown in FIG. 24B.

There are other folds which require finishing in which there are successive folds in the same direction. These are folds which are often used in notices, brochures, etc., including, for example, an inner three fold as shown in FIG. 24C and a gate fold as shown in FIG. 24D. A Z-fold shown in FIG. 24B is achieved by folding to successively perform trough folding or to successively perform crest folding.

However, the sheet folding apparatus 1 often causes displacement of the folded sheet shown in FIG. 23C when the apparatus transfers the folded sheet between rollers.

FIG. 23A shows a state in which a sheet is folded at first, the front end Pt of the folded sheet is guided to a conveying roller pair 3 by reversing the second folding roller pair 7 and with a second sheet guiding member 5. In this state, a gap occurs between an aspect from the front end Pt to the folded part Pb of the folded sheet and another aspect of the sheet part after the folded part Pb.

The diagram shown in FIG. 23B is a state in which the front end Pt of the folded sheet is inserted in the conveying roller pair 3 again in the state with the gap shown in FIG. 23A.

The diagram shown in FIG. 23C is a state in which the folded part Pb of the folded sheet is guided from the second folding roller pair 7 to the first folding roller pair 6. When the folded part Pb of the folded sheet is nipped and conveyed by the first folding roller pair 6 in this state. The folded part Pb of the folded sheet is formed to the displacement of the folded sheet.

SUMMARY

In light of the problems and circumstances as described above, a main object of the present application is to prevent forming displacement of the folded sheet when performing successive trough folding or performing crest folding.

According to an embodiment of the present application, a sheet folding apparatus includes: a conveying roller pair which feeds a sheet and a first folding roller pair and a second folding roller pair which fold the sheet fed from the conveying roller pair in turns. The first and second folding roller pairs are arranged at a predetermined gap with respect to each other. A sheet conveying speed or a sheet conveying amount of the conveying roller pair is different from a sheet conveying speed or a sheet conveying amount of the first folding roller pair or the second folding roller pair when the folded part Pb of the folded sheet is guided from the folding roller pair to another folding roller pair.

BRIEF DESCRIPTION OF THE DRAWINGS

Other objects, features, and advantages of the present application will become more apparent from the following detailed descriptions when read in conjunction with the accompanying drawings, in which.

DETAILED DESCRIPTION

Figure 1:
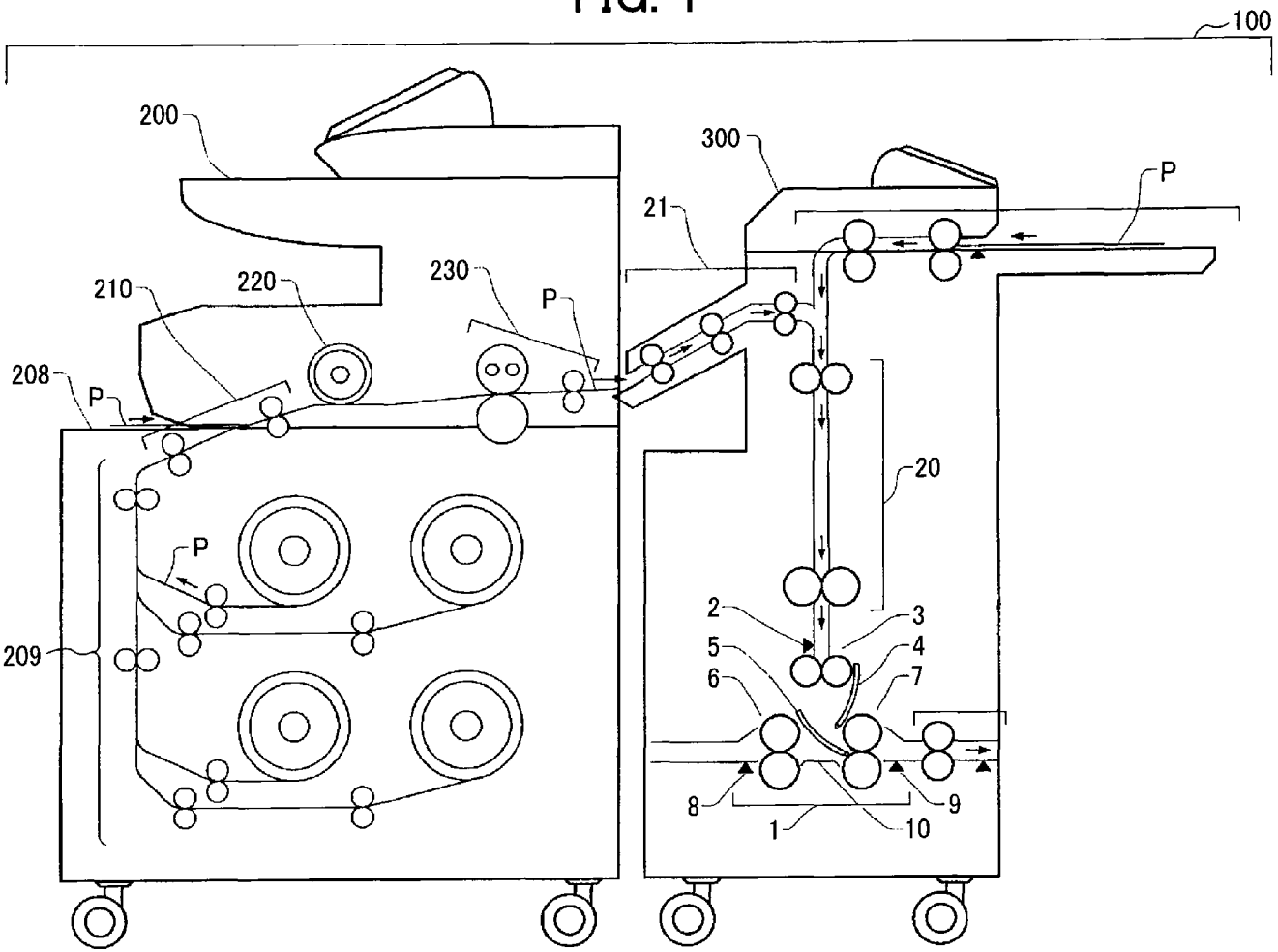
FIG. 1 is a diagram showing a schematic configuration of an image forming system which shows embodiment 1 of the present application.

The embodiments of the present application are described in detail with reference to a plurality of embodiments and drawings. For elements (parts, components, etc.,) having the same function, shape, etc., in multiple embodiments or variations, the same reference numerals are used, so that repetitive explanations are omitted after having been explained once unless there is a possibility of confusion.

Embodiment 1

In FIG. 1, an image forming system 100 includes an image forming apparatus 200 and a sheet folding apparatus 300.

In the image forming apparatus 200, a conveying member 210 conveys a sheet P which is fed by a sheet feeding member 209, an image forming unit 220 forms an image on the sheet P, and a discharge member 230 discharges the sheet P out of the image forming apparatus 200.

A sheet inlet member 21 in the sheet folding apparatus 300 connected at the discharging outlet of the image forming apparatus 200 and receives the sheet P discharged out of the image forming apparatus 200. A feeding unit 20 feeds the sheet P to a sheet folding unit 1.

In FIG. 1, an inlet sensor 2 is a sheet detecting unit arranged between the conveying roller pair 3 and the feeding unit 20. The inlet sensor 2 detects a tip of the sheet P which is conveyed from the feeding unit 20. The inlet sensor 2 is a trigger signal for use in control of an operation of each member, motor, etc., at and after a timing of detecting thereof.

Figure 2:
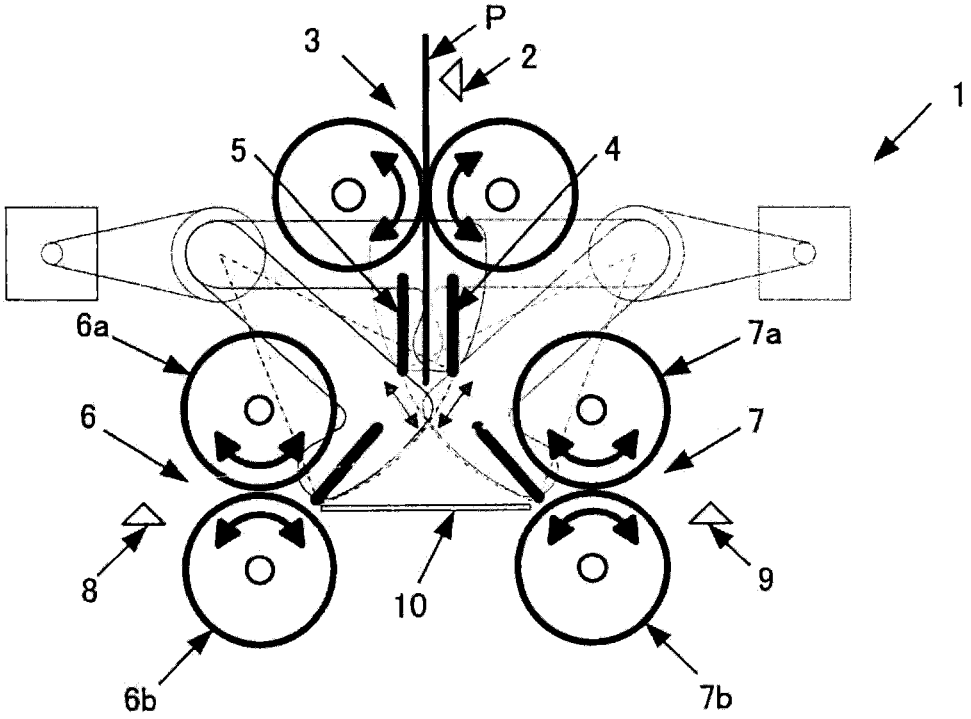
FIG. 2 is a diagram showing a detail of the sheet folding apparatus in FIG. 1.
Figure 4:
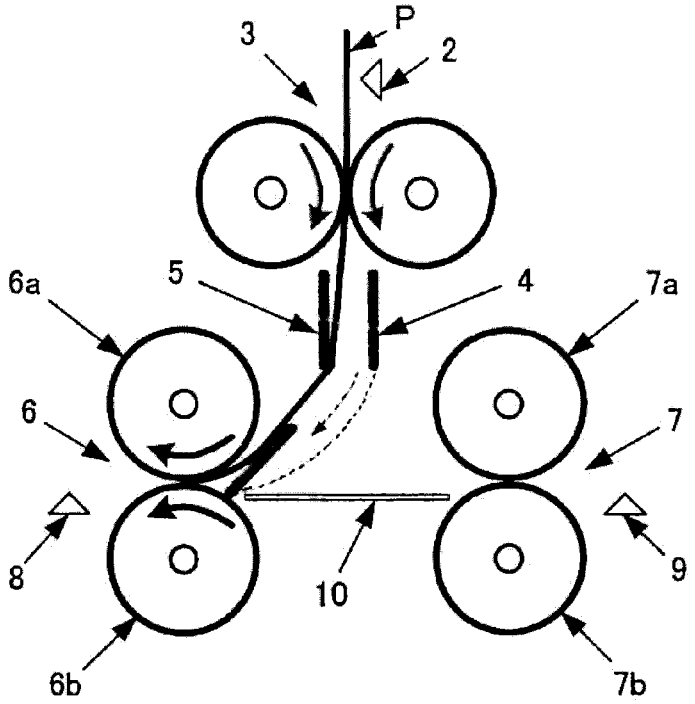
FIG. 4 is a diagram showing a schematic driving configuration of the sheet folding apparatus in FIG. 2.

FIG. 2 is a diagram showing in detail a sheet folding unit 1. As shown in FIG. 4, the sheet folding unit 1 includes the inlet sensor 2, a conveying roller pair 3, a first folding roller pair 6, a second folding roller pair 7, a first sensor 8, a second sensor 9, a first sheet guiding member 4, a second sheet guiding member 5, and a lower sheet face guide 10.

The conveying roller pair 3 is the conveying rotating pair member which conveys the sheet P. The first folding roller pair 6 and the second folding roller pair 7 are arranged, with a predetermined gap therebetween, in an opposing manner at the left and the right in a lower portion of the conveying roller pair 3. Those are the first folding rotating member pair and the second folding rotating member pair which folds the sheet P. A first sensor 8 is a first sheet detecting unit which detects a sheet P edge (including a sheet P edge portion and a folding edge portion) on the first folding roller pair 6 side. A second sensor 9 is a second sheet detecting unit which detects a sheet P edge on the second folding roller pair 7 side. A first sheet guiding member 4 is a first sheet guiding member which can undergo fluctuating displacement and operation to guide, to the first folding roller pair 6, the sheet P which is fed by the conveying roller pair 3. A second sheet guiding member 5 is a second sheet guiding member which can undergo fluctuating displacement and operation to guide, to the second folding roller pair 7, the sheet P which is fed by the conveying roller pair 3. A lower sheet face guide 10 is a lower sheet face guiding member which guides the sheet P guided by the first sheet guiding member 4 or the second sheet guiding member 5 to a nip portion between the respective rollers 6*a* and 6*b* of the first roller pair 6 or the respective rollers 7*a* and 7*b* of the second roller pair 7.

The conveying roller pair 3, the first folding roller pair 6, and the second folding roller pair 7 are supported by the apparatus body via an axle respectively such that they can undergo forward and reverse rotations. The first sheet guiding member 4 or the second sheet guiding member 5 is also a member which selectively guides, to the respective folding roller pairs 6 and 7 directions, the sheet P which is conveyed from the conveying roller pair 3.

The sheet P is conveyed by the conveying roller pair 3 and selectively guided to the first folding roller pair 6 or the second folding roller pair 7 by a displacement operation of the first sheet guiding member 4 or the second sheet guiding member 5. If it is guided to the first folding roller pair 6 side, a tip or a folding edge of the sheet P is detected by the first sensor 8 and, with this detected time as a reference, the first folding roller pair 6 undergoes a reverse rotation after being conveyed for a required distance. If it is guided to the second folding roller pair 7 side, a tip or a folding edge of the sheet P is detected by the second sensor 9. With this detected time as a reference, the second folding roller pair 7 undergoes a reverse rotation after being conveyed for a required distance. In alignment with this reverse rotation, the first sheet guiding member 4 is caused to undergo a displacement operation at a time of conveying to the first folding roller pair 6 and the second sheet guiding member 5 is caused to undergo a displacement operation at a time of conveying to the second folding roller pair 7. Then, being guided by the first sheet guiding member 4 or the second sheet guiding member 5 from inside a sheet folded portion Pb of the sheet P, a lower face of the sheet P is folded a predetermined number of times by being slid on an upper face of the lower sheet face guide 10 and fed to the first folding roller pair 6 or the second folding roller pair 7 toward which there is a conveying direction.

Figure 3:
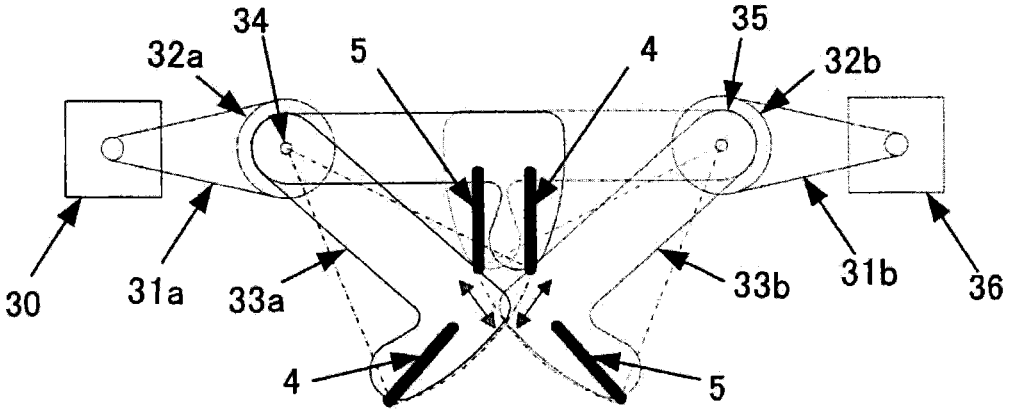
FIG. 3 is a diagram showing a schematic driving configuration of the sheet folding apparatus in FIG. 2.

As shown in FIG. 3, a driving system for the first sheet guiding member 4 includes a sheet guiding member driving arm 33*a*, a first sheet guiding member operating pivotal axle 34, a sheet guiding member driving pulley 32*a*, a sheet guiding member driving belt 31*a*, and a first sheet guiding member driving motor 30.

A driving system for the second sheet guiding member 5 includes a sheet guiding member driving arm 33*b*, a second sheet guiding member operating pivotal axle 35, a sheet guiding member driving pulley 32*b*, a sheet guiding member driving belt 31*b*, and a second sheet guiding member driving motor 36.

The driving system of the first sheet guiding member 4 and the driving system of the second sheet guiding member 5 are configured to be generally the same, so that explanations are given below with the driving system of the first sheet guiding member 4 being represented.

The first sheet guiding member 4 is fixed to the arm 33*a*. The pulley 32*a* is supported to be able to turn, or in other words, to fluctuate within a predetermined angular range to one of side plates (the side of the side plate which is arranged on the front side of a sheet face) that is an immobile member (not shown) on the apparatus body side. The arm 33*a* is fixed to the pulley 32*a* with the operating pivotal axle 34. A motor 30, which is fixed to the side plate, is arranged in the vicinity of the pulley 32*a*. A belt 31*a* is stretched between a motor pulley which is fixed to an output axle of the motor 30 and the pulley 32*a*, so that the motor 30, the pulley 32*a*, and the arm 33*a* are in a driving force transmitting relationship. With the driving system of the above-described configuration, the driving force of the motor 30 is transmitted to the arm 33*a* and a position of the first sheet guiding member 4 is changed to allow a displacement operation, making it possible to guide from inside a sheet folded portion Pb and a tip Pt of a sheet P (see FIGS. 4 and 5).

For the second sheet guiding member 5, a displacement operation which is similar to that for the first sheet guiding member 4 is performed, so that guiding is performed from inside the sheet folded portion Pb and the tip Pt of the sheet P. However, operations of the first sheet guiding member 4 and the second sheet guiding member 5 need to be performed independently. Therefore, the displacement operation of the second sheet guiding member 5 is performed by driving of the second sheet guiding member driving motor 36, which is independent of the first sheet guiding member driving motor 30. The pulley 32*b* and the arm 33*b* are fixed to the operating pivotal axle 34, which is supported to be able to fluctuate to the other of side plates (the side of the side plate which is arranged on the back side of a sheet face) not shown.

In FIG. 3, a position of the first sheet guiding member 4 which is fixed to the arm 33*a* (that is shown in a solid line) and a position of the second sheet guiding member 5 which is fixed to the arm 33*b* (that is shown in a solid line) are respective home positions. Also shown is a position at which the first and second sheet guiding members 4 and 5 (shown in a long dashed double-short dashed line), which are fixed in a corresponding manner to arms 33*a* and 33*b*, undergo a displacement operation via a fluctuating displacement and operation of each arm 33*a* and 33*b* by driving of the respective motors 30 and 36.

FIGS. 4 to 13 are schematic diagrams which show how trough folding is mainly performed in a successive manner.

As shown in FIG. 4, in a home position state in which the first sheet guiding member 4 and the second sheet guiding member 5 are arranged in parallel such that they oppose each other, a tip Pt of the sheet P, which is conveyed by the conveying roller pair 3, which is rotating in a direction shown by the arrow, is guided by a displacement operation of the first sheet guiding member 4. Then, as the sheet P is guided to the first folding roller pair 6, which is rotating in a direction shown by the arrow, and as conveying of the sheet P is continued, the sheet P enters a nip portion of the first folding roller pair 6, so that the sheet P is placed therebetween and conveyed. After this, the tip Pt of the sheet P is detected by the first sensor 8. Before or after this operation, the first sheet guiding unit 4 undergoes a displacement operation and returns to an original home position.

Figure 5:
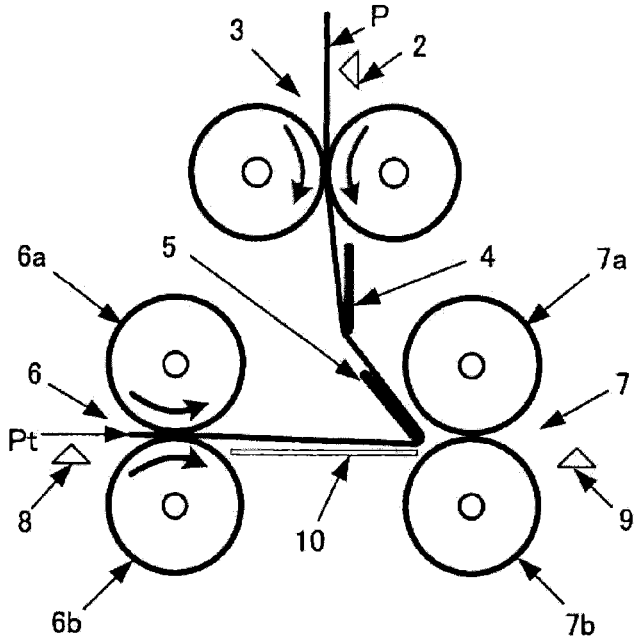
FIG. 5 is a diagram illustrating an operation which guides the folded part of the folded sheet to a nip of a second folding roller pair from a state in FIG. 4.
Figure 6:
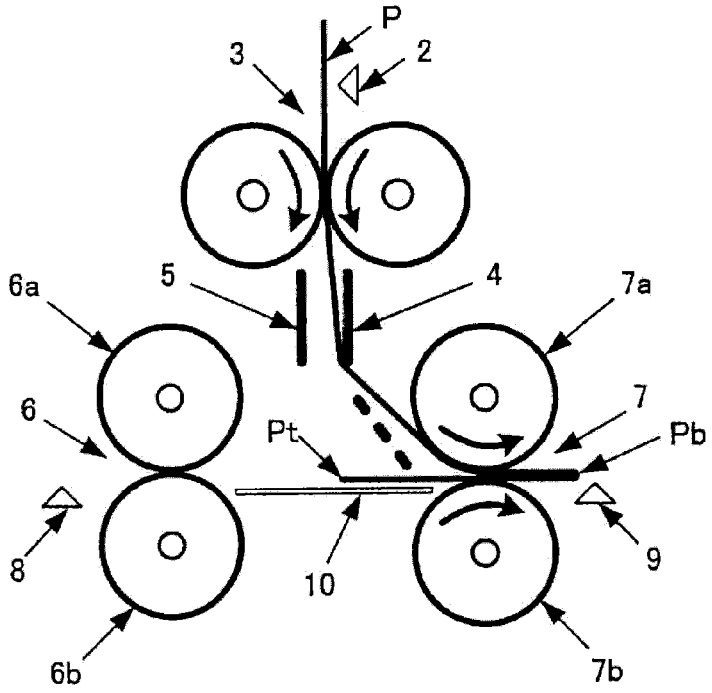
FIG. 6 is a diagram illustrating an operation in which a sheet in FIG. 5 is folded, and a second sheet guiding member moves back to home position.

Next, as shown in FIG. 5, after conveying for a required distance with a detected timing of the first sensor 8 as a reference, the first folding roller pair 6 undergoes a reverse rotation. Then, the sheet folded portion Pb of the sheet P is guided from inside the sheet folded portion Pb by a displacement operation of the second sheet guiding member 5 and guided to the second folding roller pair 7, which is arranged in an opposing manner. As shown in FIG. 6, as conveying is continued, the sheet P enters a nip portion of the second folding roller pair 7 and is placed therebetween and conveyed, so that folding is formed. The folding edge formed is detected by the second sensor 9. Before or after this operation, the second sheet guiding member 5 undergoes a displacement operation and returns to an original home position.

Figure 7:
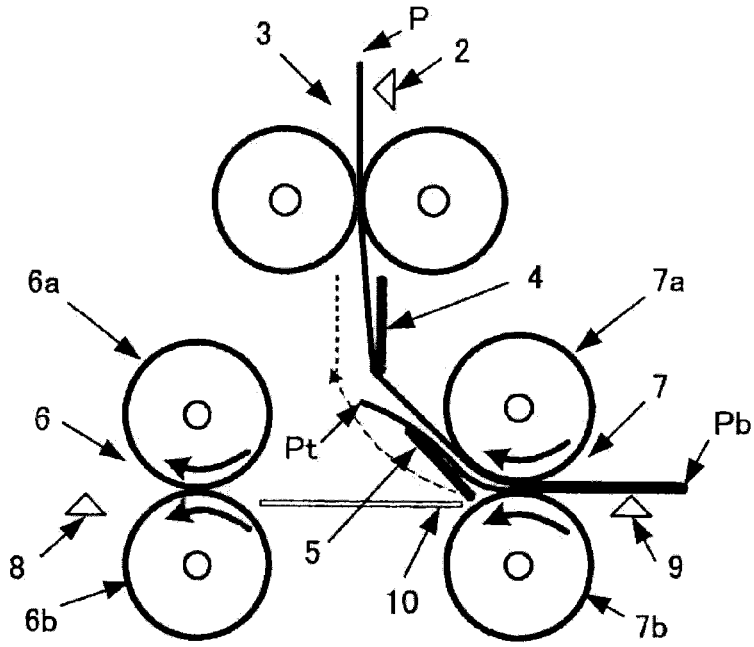
FIG. 7 is a diagram illustrating an operation which guides a sheet tip by the second sheet guiding member, and the second sheet guiding member prevents the sheet from moving to the first folding roller pair.
Figure 8:
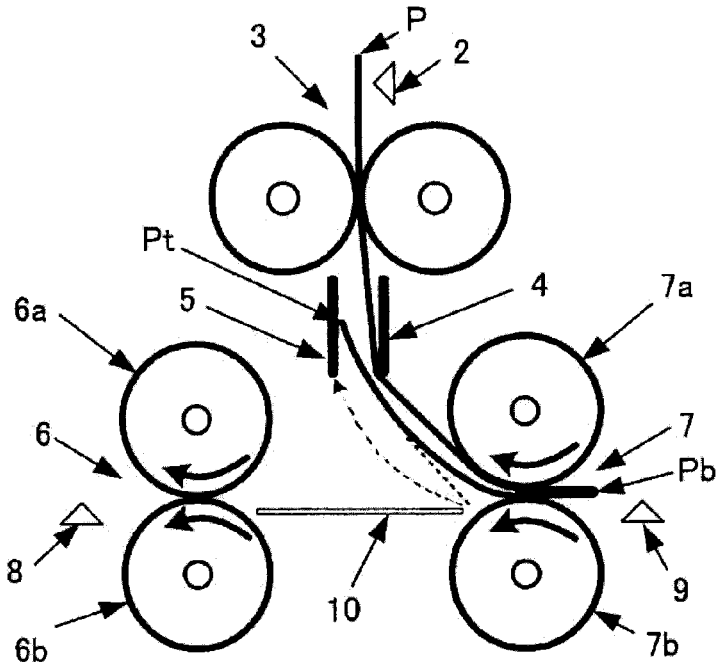
FIG. 8 is a diagram illustrating an operation which guides a sheet tip while the second sheet guiding member returns from the state in FIG. 7 to the home position, and where the second sheet guiding member prevents the sheet from moving to the first folding roller pair.

Then, as shown in FIG. 7, after conveying for a required distance with a detected timing of the second sensor 9 as a reference, the second folding roller pair 7 undergoes a reverse rotation. Then, the sheet folded portion Pb of the sheet P is conveyed toward the first folding roller pair 6. At that time, the second sheet guiding member 5 operates from the state in FIG. 7 to the state in FIG. 8. The operation guides the tip Pt of the sheet P, and prevents the tip Pt of the sheet P from moving to the first folding roller pair 6. In the state in FIG. 8, the second folding roller pair 7 conveys the sheet P to the first folding roller pair 6 as shown in FIG. 9.

Figure 10:
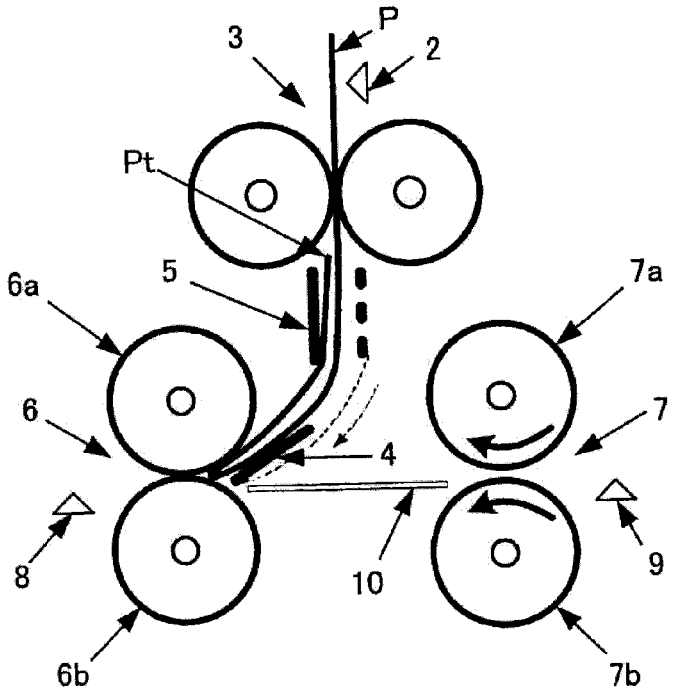
FIG. 10 is a diagram illustrating an operation where the first sheet guiding member moves, and where a sheet is guided from the state in FIG. 9 to the first folding roller pair and nipped by the first folding roller pair.
Figure 11:
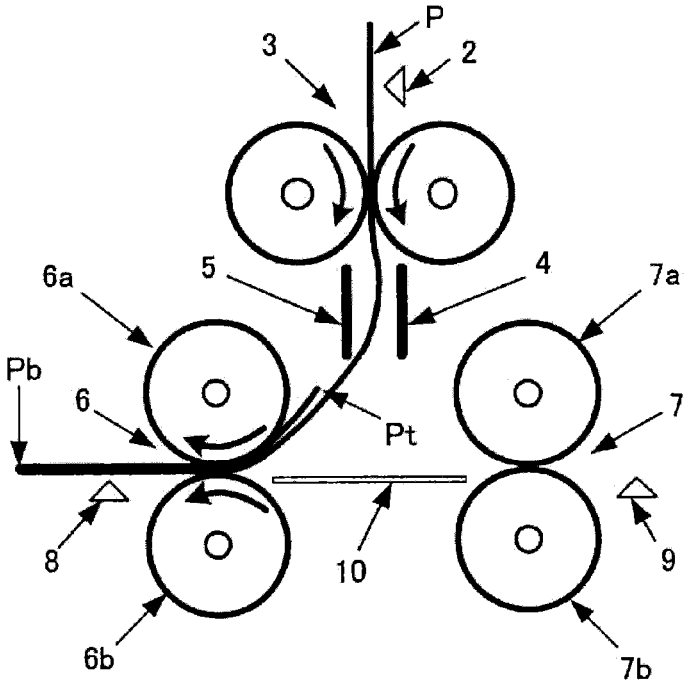
FIG. 11 is a diagram illustrating an operation which senses a sheet from the state in FIG. 10 by a first sensor, and a sheet is further conveyed.

Thereafter, the sheet P is guided to the first folding roller pair 6 and is placed therebetween and conveyed as shown in FIG. 10 by an operation of the first sheet guiding member 4, and the sheet P is detected by the first sensor 8.

Figure 12:
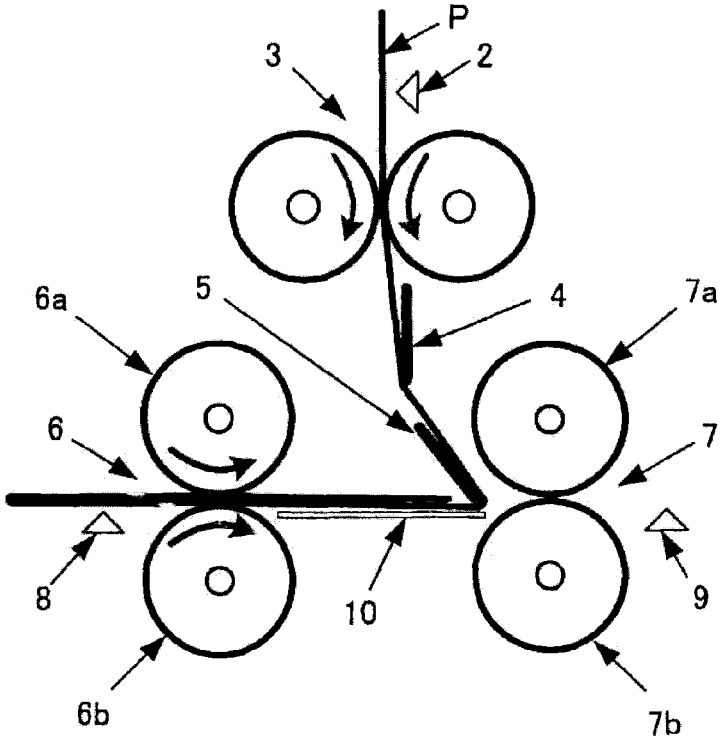
FIG. 12 is a diagram illustrating an operation which guides a sheet tip to the second folding roller pair by an operation of reversing the first folding roller pair from the state in FIG. 11.
Figure 13:
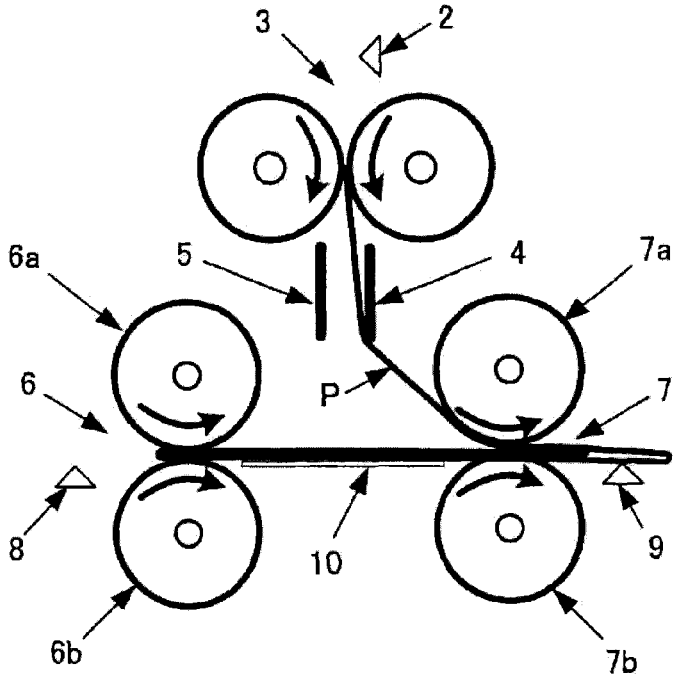
FIG. 13 is a diagram illustrating an operation which forms a second folding part from the state in FIG. 12 by an operation of the second folding roller pair.

Then, as shown in FIG. 12, after conveying the sheet P for a required distance with a detected timing of the first sensor 8 as a reference, the first folding roller pair 6 undergoes a reverse rotation. Then, the portion of the sheet P in which a second folding is carried out is guided from inside the sheet folded portion Pb by a displacement operation of the second sheet guiding member 5 and guided to the second folding roller pair 7, which is arranged in an opposing manner. It enters the second folding roller pair 7 and is placed therebetween and conveyed by continued conveying, so that the second folding is formed. An edge of the second folding formed is detected by the second sensor 9. With this detection by the second sensor 9 as a reference, the following operation is selected, making it possible to successively perform trough folding and successively perform crest folding.

Figure 9:
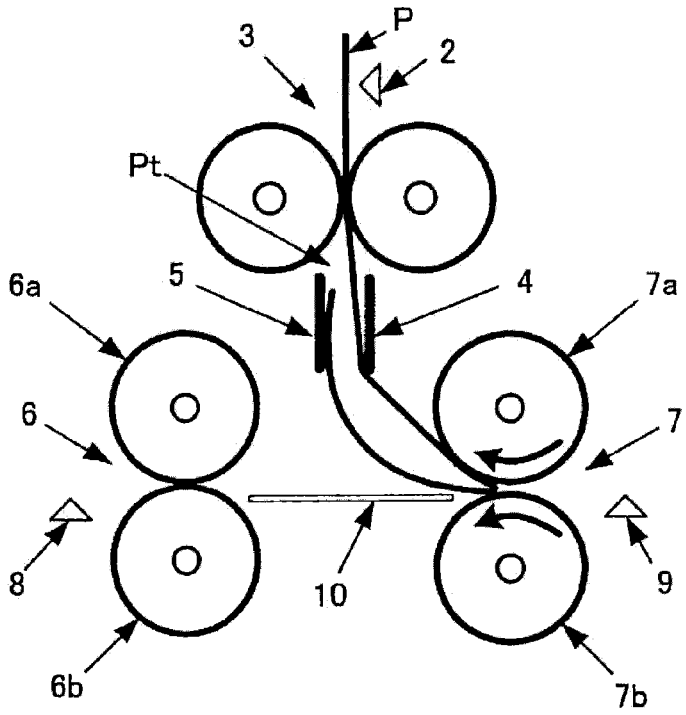
FIG. 9 is a diagram illustrating an operation in which the second folding roller pair conveys a sheet from the state in FIG. 8 to the first folding roller pair.
Figure 23A:
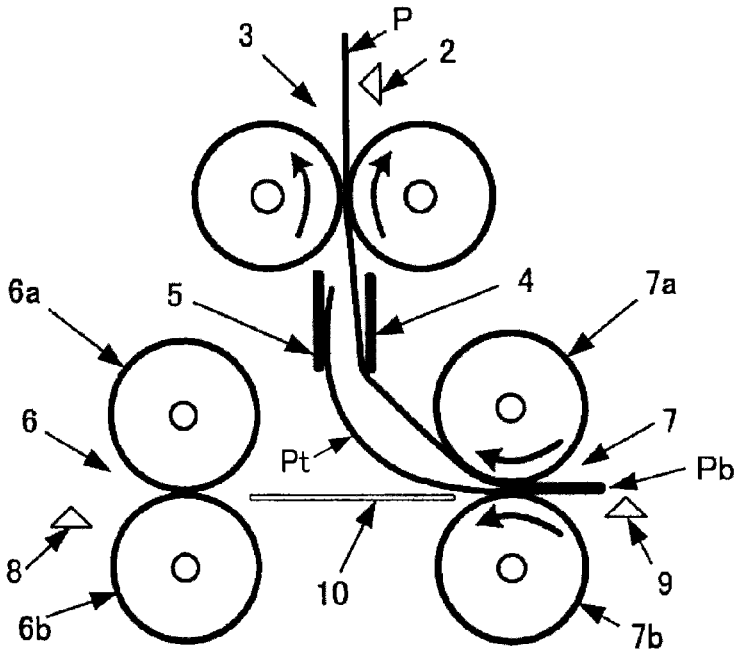
FIGS. 23A-23C illustrate an operation in the sheet folding apparatus according to a related-art.
Figure 23B:
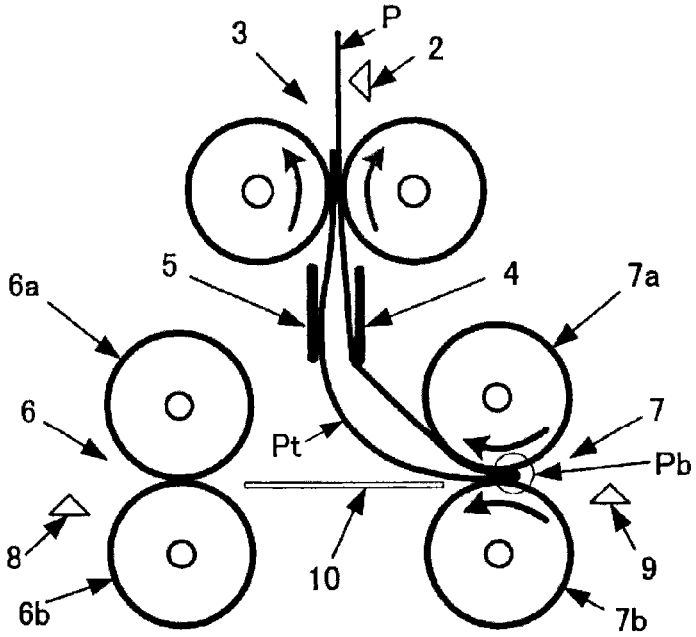
Figure 23C:
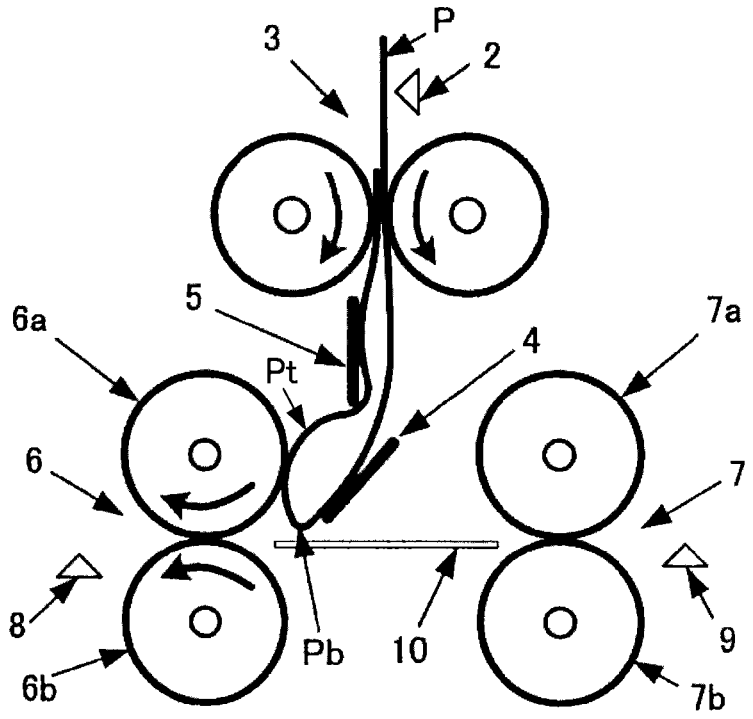
Figure 24A:
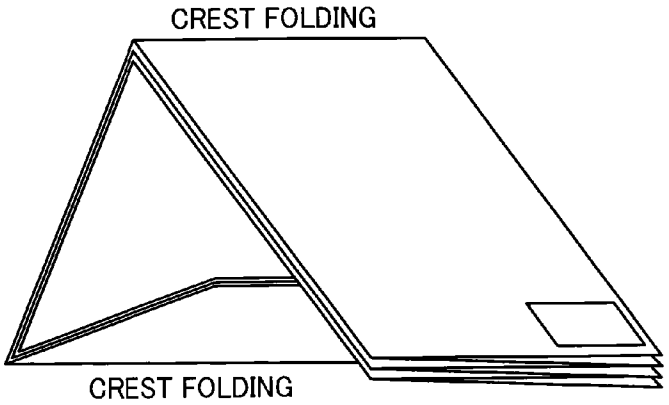
FIGS. 24A-24D show a generally well known method to fold a drafting sheet.
Figure 24B:
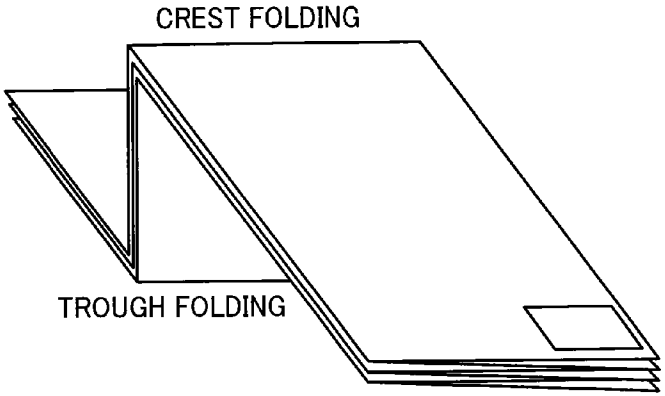
Figure 24C:
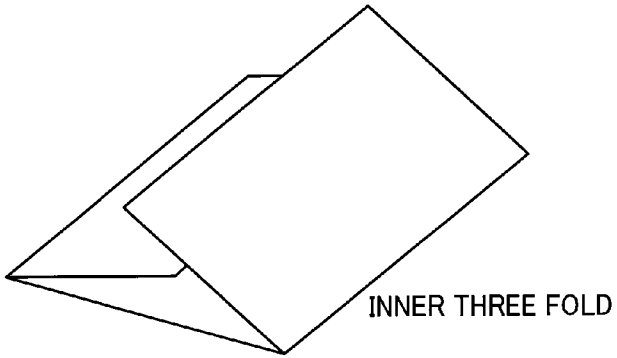
Figure 24D:
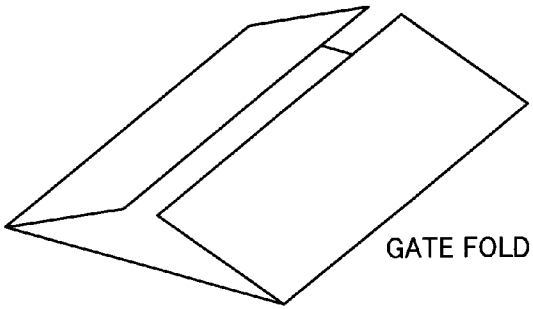

In embodiment 1 of the present application, as shown in FIG. 9, a tension state of the sheet P between a nip of the second folding roller pair 7 and the first sheet guiding unit becomes loose. Then the present application prevents formation of displacement of the folded sheet P as shown in FIG. 23C.

Figure 14A:
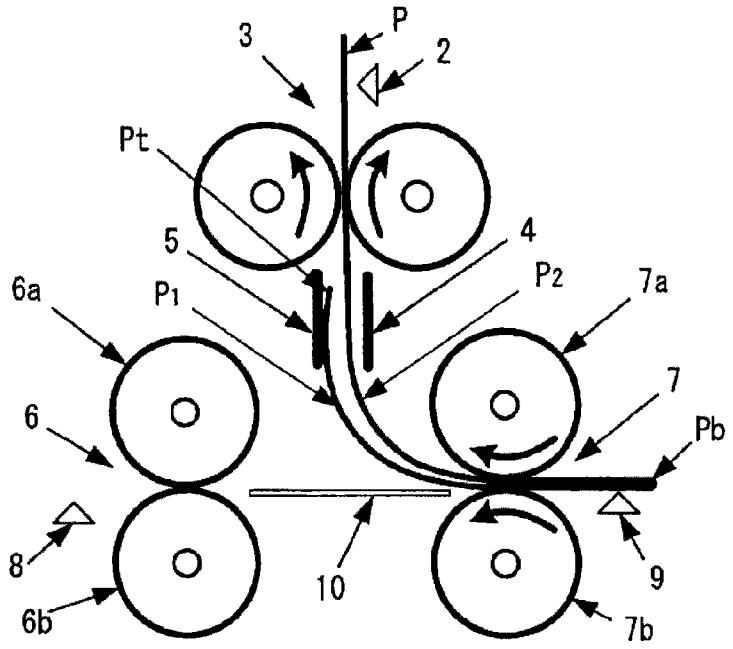
FIGS. 14A-14C illustrate an operation in the sheet folding apparatus according to embodiments 1, 2, and 5.
Figure 14B:
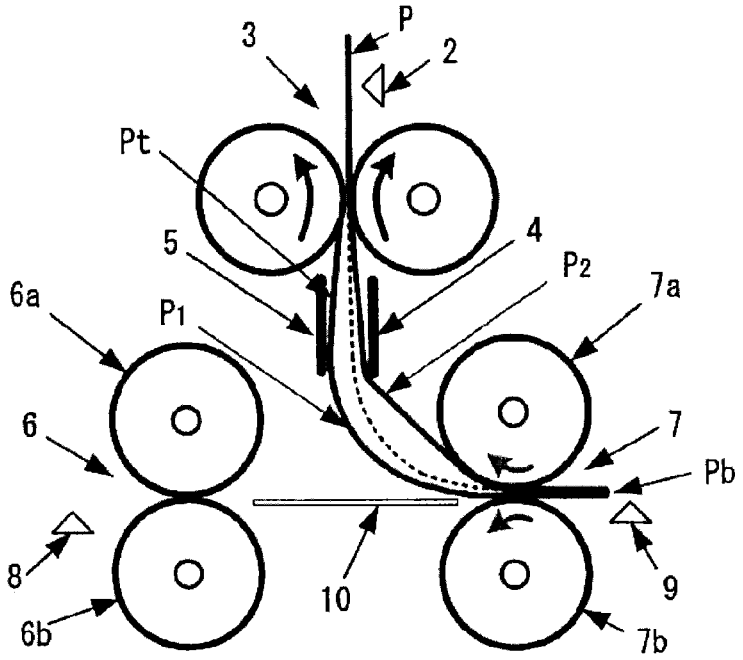
Figure 14C:
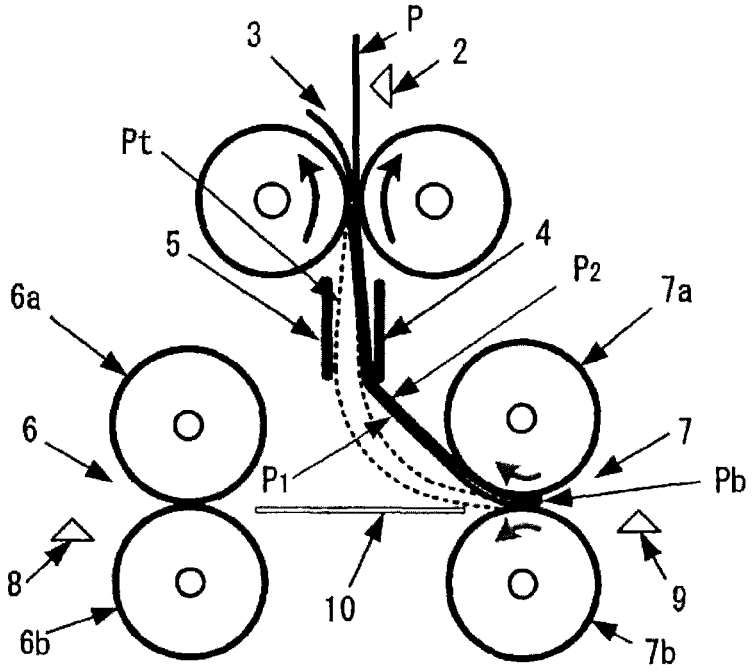

FIGS. 14A-14C illustrate an operation in the sheet folding apparatus 1 and show an operation following FIG. 9. FIG. 14A is a diagram showing that a state of the sheet P in FIG. 9 is slacked. In FIG. 14A, a part P1 of the sheet P and another part P2 of the sheet P are slacked each, and the tip Pt of the sheet P is conveyed to the conveying roller pair 3 in a state with the gap between the part P1 of the sheet P and another part P2 of the sheet P.

FIG. 14B shows a state of the tip Pt of the sheet P conveyed in a state that is slacked and with the gap in FIG. 14A reaches to the conveying roller pair 3. FIG. 14C shows a state of the tip Pt of the sheet P conveyed more by a state in FIG. 14B, and enters in the conveying roller pair 3.

The sheet P is conveyed with a gap of a sheet conveying speed (a sheet conveying amount) between the conveying roller pair 3 and the first folding roller pair 6 or the second folding roller pair 7, when the sheet folded portion Pb of the sheet P is guided from one folding roller pair (6 or 7) to another folding roller pair (6 or 7), which is arranged in an opposing manner. In other words, the sheet conveying speed (the sheet conveying amount) of the conveying roller pair 3 is different from that of the first folding roller pair 6 or the second folding roller pair 7.

In that way the slack of the sheet P, between the conveying roller pair 3 and the first folding roller pair 6 or the second folding roller pair 7, is able to be removed. Therefore, formation of displacement of the folded sheet when the sheet is folded is prevented.

Embodiment 1 of the present application is explained as a case to successively perform trough folding, or to successively perform crest folding, as well as to alternately perform crest folding and trough folding.

Embodiment 2

As shown in FIG. 14, Embodiment 2 is an example that the conveying roller pair 3 conveys the sheet P faster than does the first folding roller pair 6 or the second folding roller pair 7 dose. Thus, the slack of the sheet P, between the conveying roller pair 3 and the first folding roller pair 6 or the second folding roller pair 7, is able to be removed, as shown in FIG. 14C.

On the other hand, the conveying roller pair 3 conveys the sheet P more than does the first folding roller pair 6 or the second folding roller pair 7. Thus, the slack of the sheet P is able to be eliminated similarly.

In addition to an effect of embodiment 1, embodiment 2 has the following effect: The slack of the sheet P is able to be removed while the first folding roller pair 6 or the second folding roller pair 7 is conveying the sheet P to the conveying roller pair 3.

Embodiment 3

Figure 15A:
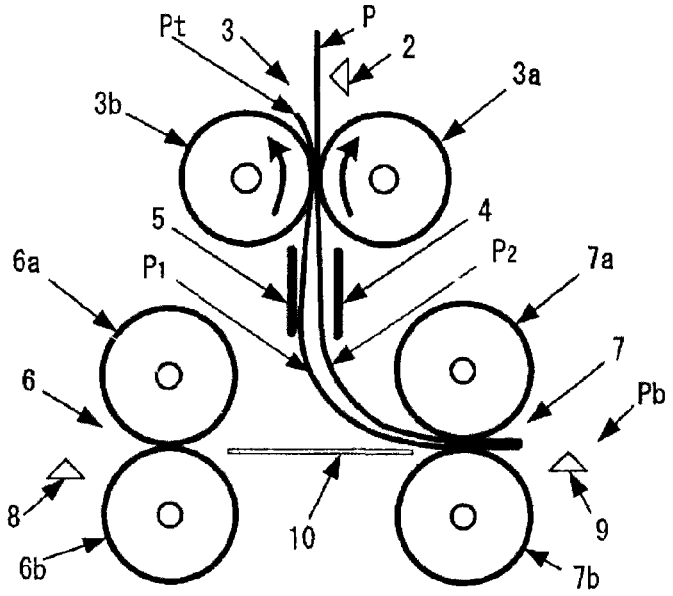
FIGS. 15A-15C illustrate an operation in the sheet folding apparatus according to embodiment 3.
Figure 15B:
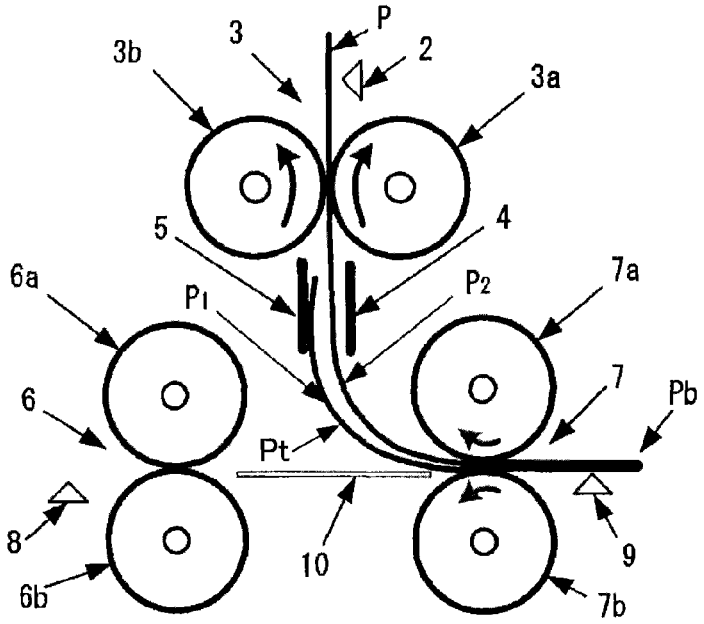
Figure 15C:
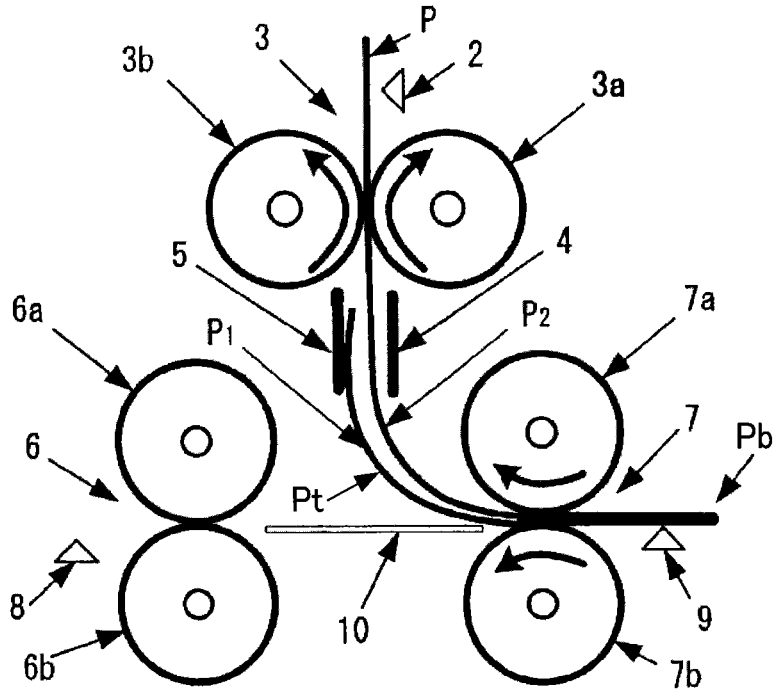

FIGS. 15A-15C illustrate an operation in the sheet folding apparatus 1, which show embodiment 3. The sheet P is capable of causing to be slacked, by changing the relative operation of the conveying roller pair 3, the first folding roller pair 6 and the second folding roller pair 7, during a series operation of FIG. 14 shown in embodiment 2. Therefore, an operation of embodiment 3 is changing the conveying speed.

In FIG. 15A, conveying amount of the sheet P is reduced by stopping temporarily to convey the sheet P with the first folding roller pair 6 and the second folding roller pair 7, during a series operation shown in FIG. 14. Therefore, the sheet conveying amount with the conveying roller pair 3 is larger than the sheet conveying amount with the first folding roller pair 6 and the second folding roller pair 7. Thus, the slack of the sheet P is able to be removed, and the operation prevents formation of displacement of the folded sheet when the sheet is folded.

In FIG. 15B, the conveying amount of the sheet P is reduced by slowing down the conveying speed with the first folding roller pair 6 and the second folding roller pair 7, during a series operation shown in FIG. 14. Therefore, the sheet conveying amount with the conveying roller pair 3 is larger than the sheet conveying amount with the first folding roller pair 6 and the second folding roller pair 7. As such, the slack of the sheet P is able to be removed, and the operation prevents formation of displacement of the folded sheet when the sheet is folded.

In FIG. 15C, the conveying amount of the sheet P is increased by speeding up the conveying speed with the conveying roller pair 3, during a series operation shown in FIG. 14. Therefore, the sheet conveying amount with the conveying roller pair 3 is larger than the sheet conveying amount with the first folding roller pair 6 and the second folding roller pair 7. As such, the slack of the sheet P is able to be removed without lowering productivity, and the operation prevents formation of displacement of the folded sheet when the sheet is folded.

In addition, the operation of conveying with the conveying roller pair 3, the first folding roller pair 6, and the second folding roller pair 7 is changed, in a state where the tip Pt of the sheet enters in the conveying roller pair 3, and the part P1 and the part P2 of the sheet P is conveyed with the conveying roller pair 3, the first folding roller pair 6, and the second folding roller pair 7, as shown in FIG. 15A.

Embodiment 4

Figure 16A:
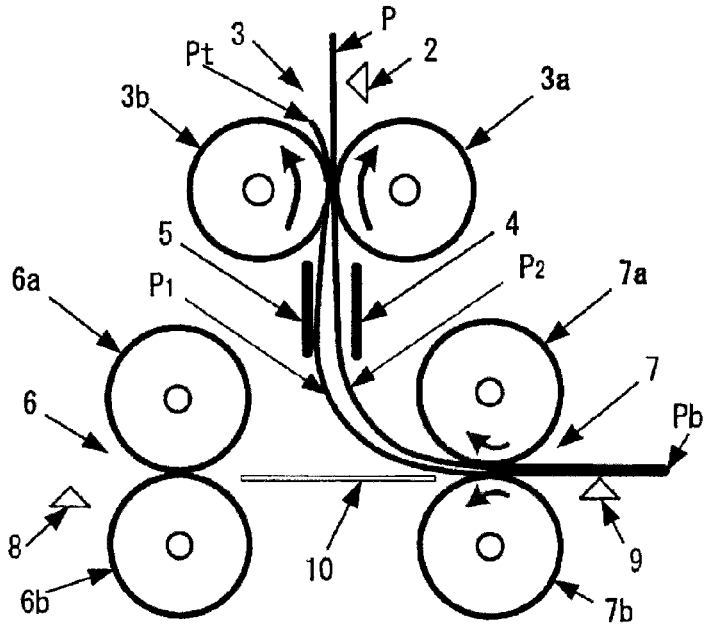
FIGS. 16A-16C illustrate an operation in the sheet folding apparatus according to embodiment 4.
Figure 16B:
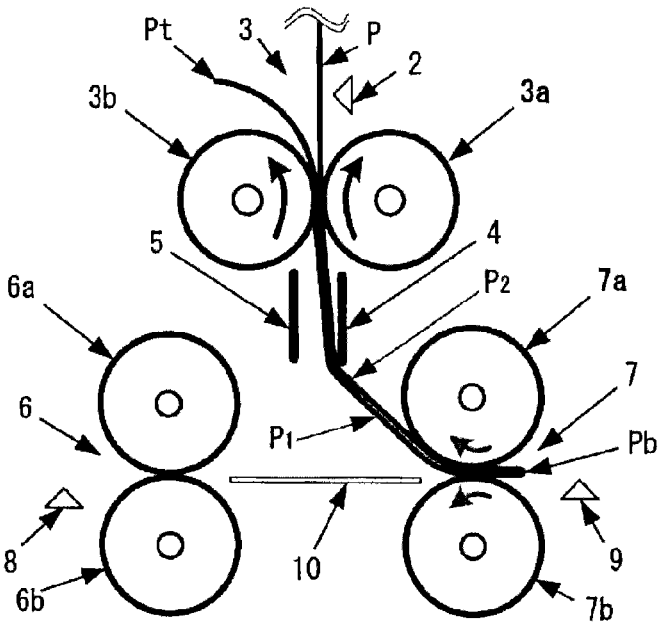
Figure 16C:
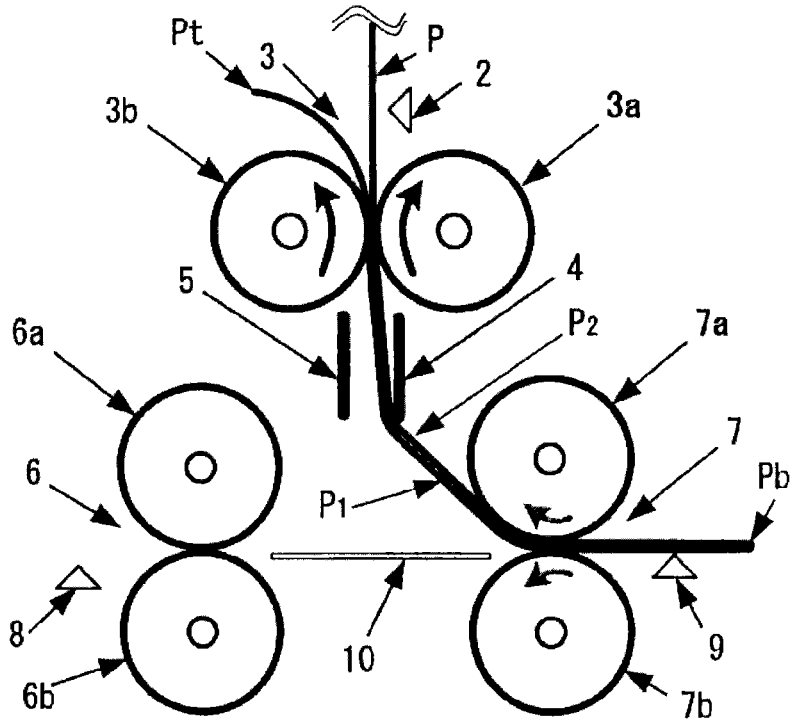

FIGS. 16A-16C illustrate an operation in the sheet folding apparatus 1, which show embodiment 4.

FIGS. 16A and 16B show that a conveying speed and force of the conveying roller pair 3 is larger than those of the first folding roller pair 6 or the second folding roller pair 7. Therefore, the slack of the sheet P is able to be removed. Then a gap of the conveying speed is absorbed by a conveying slip of the second folding roller pair 7.

FIG. 16C shows that a conveying speed of the conveying roller pair 3 is larger than that of the first folding roller pair 6 or the second folding roller pair 7, and a conveying force of the first folding roller pair 6 or the second folding roller pair 7 is larger than those of the conveying roller pair 3.

As such, the slack of the sheet P is able to be removed. Then a gap of the conveying speed is absorbed by a conveying slip of the conveying roller pair 3.

Embodiment 4 is the operation in a state where the tip Pt of the sheet enters in the conveying roller pair 3, and the part P1 and the part P2 of the sheet P is conveyed with the conveying roller pair 3, the first folding roller pair 6, and the second folding roller pair 7. Therefore, the operation is able to remove the slack of the sheet P, and prevents formation of displacement of the folded sheet.

Embodiment 5

The operation of embodiment 4 carried out when the sheet P is conveyed from the first folding roller pair 6 or the second folding roller pair 7 to the conveying roller pair 3 as shown in FIG. 14A to FIG. 14C.

Embodiment 6

Figure 17:
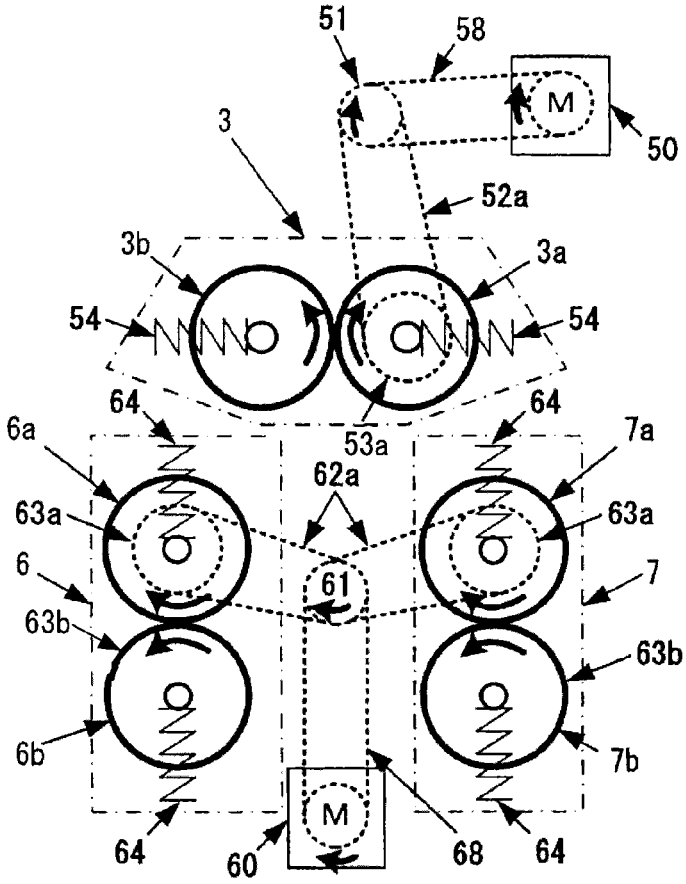
FIG. 17 is a diagram showing a driving operation of a conveying roller pair and folding roller pairs in the sheet folding apparatus according to embodiment 6.

FIG. 17 shows a driving operation of the conveying roller pair 3, the first folding roller pair 6, and the second folding roller pair 7 in the sheet folding apparatus, according to embodiment 6.

In FIG. 17, a rotational driving force of a motor 50 for driving a conveying roller is transmitted to a pulley 51 for driving a conveying roller through a belt 58 for driving a conveying roller, and to a pulley 53*a* for driving a pressing roller through a belt 52*a* for driving a pressing roller. The rotational driving force transmitted to the pulley 53*a* for driving a pressing roller drives the conveying roller pair 3.

A rotational driving force of a motor 60 for driving a folding roller is transmitted to a pulley 61 for driving a folding roller through a belt 68 for driving a folding roller, and to a pulley 63*a* for driving a pressing roller through a belt 62*a* for driving a pressing roller. The rotational driving force transmitted to the pulley 63*a* for driving a pressing roller drives the first folding roller pair 6 and the second folding roller pair 7.

On the other hand, the conveying roller pair 3 includes a pressing roller 3*a* and a conveying roller 3*b*. The pressing roller 3*a* and the conveying roller 3*b* are each pressure-contacted by a spring 54 for pressing a conveying roller. The first folding roller pair 6 includes a pressing roller 6*a* and a folding roller 6*b*. The pressing roller 6*a* and the conveying roller 6*b* are each pressure-contacted by a spring 64 for pressing a folding roller. The first folding roller pair 7 includes a pressing roller 7*a* and a folding roller 7*b*. The pressing roller 7*a* and the conveying roller 7*b* are each pressure-contacted by a spring 64 for pressing a folding roller.

In FIG. 17, for example, a conveying force gap between the conveying roller pair 3 and the first folding roller pair 6 or the second folding roller pair 7 is caused by setting it so that a pressing force of the spring 54 is different from that of the spring 64.

Embodiment 7

Figure 18:
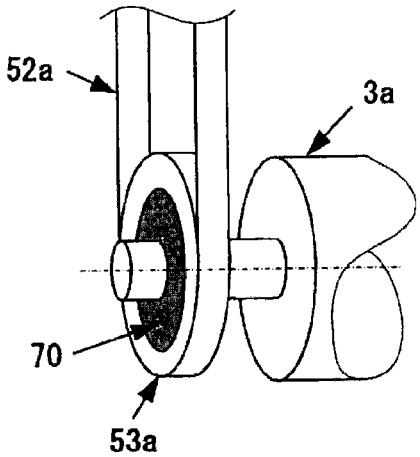
FIG. 18 is an enlarged perspective view showing a driving operation of a pressure roller constituted by a conveying roller pair in the sheet folding apparatus according to embodiment 7.

FIG. 18 is an enlarged perspective view showing a driving operation of a pressure roller constituted by a conveying roller pair in the sheet folding apparatus according to embodiment 7. A torque limiter 70 is attached with a driving shaft in the pulley 53*a* for driving a pressing roller shown in FIG. 17. A rotary driving force with more than a torque set in the torque limiter 70 isn't transmitted from the pulley 53*a* for driving a pressing roller to the pressing roller 3*a*.

A torque limiter 70 is attached with a driving shaft in one lowering the conveying force among the conveying roller pair 3, the first folding roller pair 6 and the second folding roller pair 7. Therefore, the conveying force gap between the conveying roller pair 3 and the first folding roller pair 6 or the second folding roller pair 7 is caused. At that time, the torque limiter 70 is able to absorb the gap of the conveying speeds. Therefore, the displacement of the folded sheet is prevented without damaging to the sheet with slip between the sheet P and the conveying roller pair 3 or the first folding roller pair 6 or the second folding roller pair 7.

Embodiment 8

Figure 19:
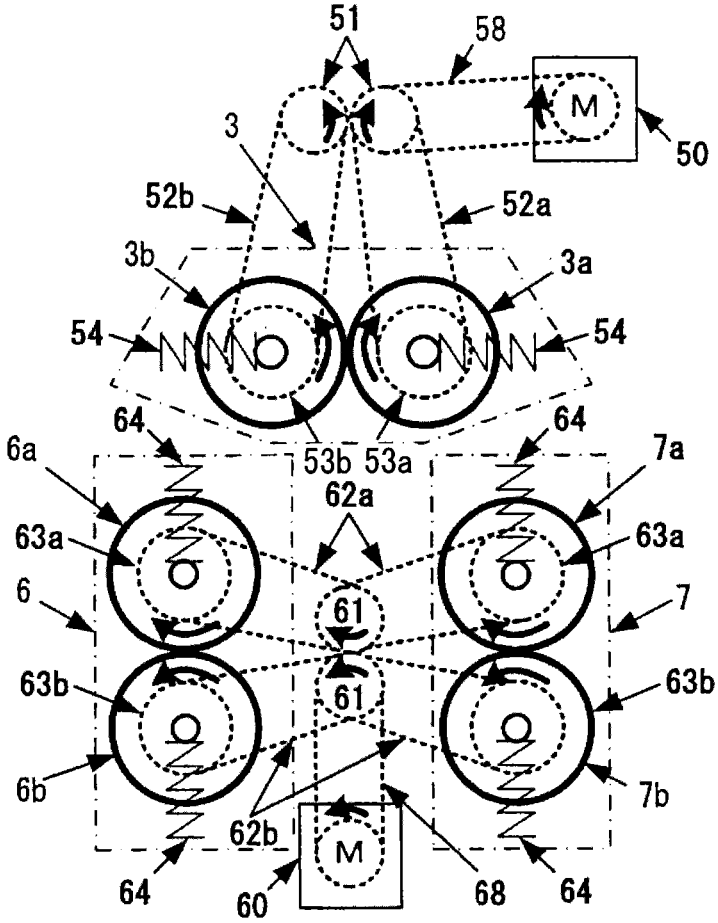
FIG. 19 is a diagram showing a driving operation of a conveying roller pair and folding roller pairs in the sheet folding apparatus according to embodiment 8.

FIG. 19 is a diagram showing a driving operation of the conveying roller pair 3, the first folding roller pair 6, and the second folding roller pair 7 in the sheet folding apparatus according to embodiment 8. A drive system in FIG. 19 also drives a roller and a counter roller among roller pair.

In FIG. 19, a rotational driving force of a motor 50 for driving a conveying roller is transmitted to pulleys 51 for driving conveying rollers respectively through a belt 58 for driving a conveying roller. In addition, the rotational driving force is transmitted to a pulley 53*a* for driving a pressing roller and a pulley 53*b* for driving a conveying roller through a belt 52*a* for driving a pressing roller and a belt 52*b* for driving a conveying roller. Then the rotational driving force transmitted drives both the pressing roller 3*a* and the conveying roller 3*b*, that is the conveying roller pair 3.

A rotational driving force of a motor 60 for driving a folding roller is transmitted to a pulley 61 for driving a folding roller through a belt 68 for driving a folding roller. In addition, the rotational driving force is transmitted to a pulley 63*a* for driving a pressing roller and a pulley 63*b* for driving a folding roller through a belt 62*a* for driving a pressing roller and a belt 62*b* for driving a folding roller. The rotational driving force transmitted to the pulleys 63*a* for driving a pressing roller and to the pulleys 63*b* for driving a folding roller drive the pressing roller 6*a* and the folding roller 6*b* composed of the first folding roller pair 6, and the pressing roller 7*a* and the folding roller 7*b* composed of the second folding roller pair 7.

FIG. 20 is a diagram illustrating an operation in effect according to embodiment 8.

Figure 20A:
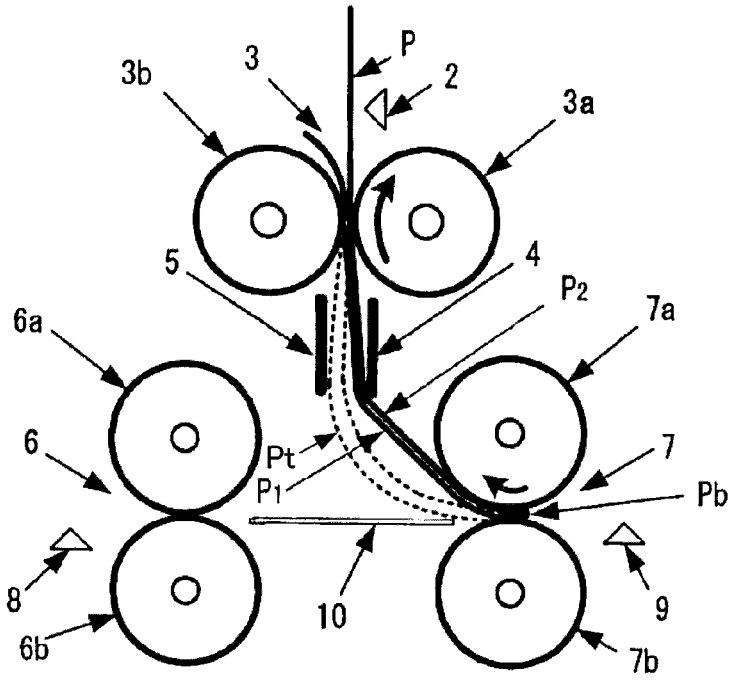
FIGS. 20A-20C illustrate an operation in effect according to embodiment 8.

In FIG. 20A, the slack of the sheet part P1 is equal with that of the sheet part P2, and only one side of the roller pair 3,6,7 is driven. Therefore both slacks of the sheet part P1 and the sheet part P2 are removed.

Figure 20B:
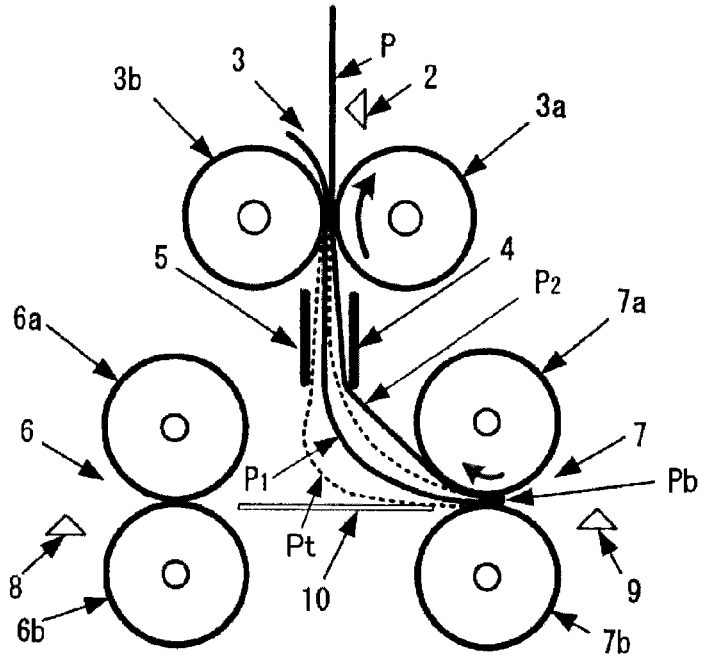

In FIG. 20B, the slack of the sheet part P1 is larger than that of the sheet part P2, and only one side of the roller pair 3,6,7 is driven. The sheet part P1 is maintained and the displacement of the folded sheet is caused because the pressing roller 3*a* can't convey the sheet part P1 when the slack of the sheet part P2 is removed.

Figure 20C:
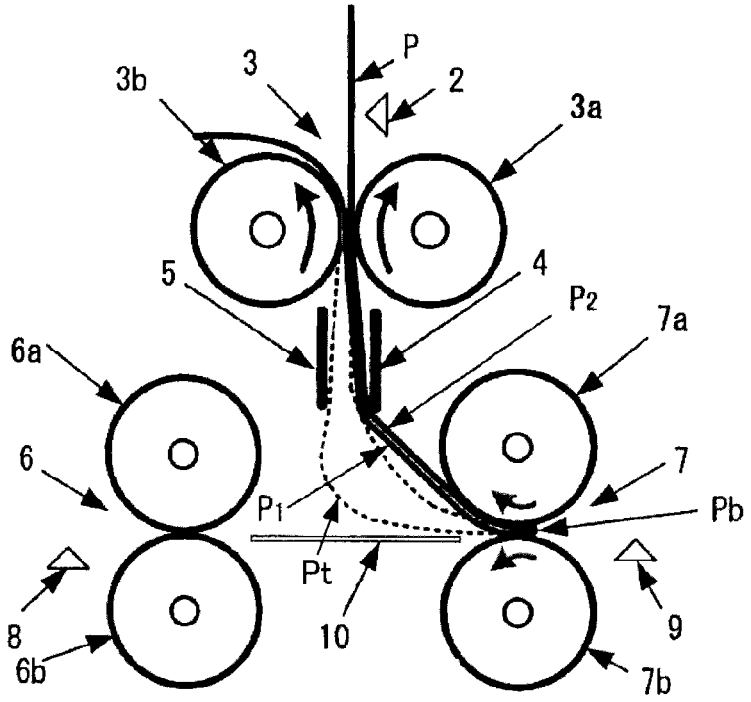

In FIG. 20C, the slack of the sheet part P1 is larger than that of the sheet part P2, and both sides of the roller pair 3,6,7 are driven. Therefore, the slack of the sheet part P1 is also removed by conveying with the conveying roller 3*b* regardless of the state of the slacked sheet, as shown in FIG. 20B.

Embodiment 9

Figure 21:
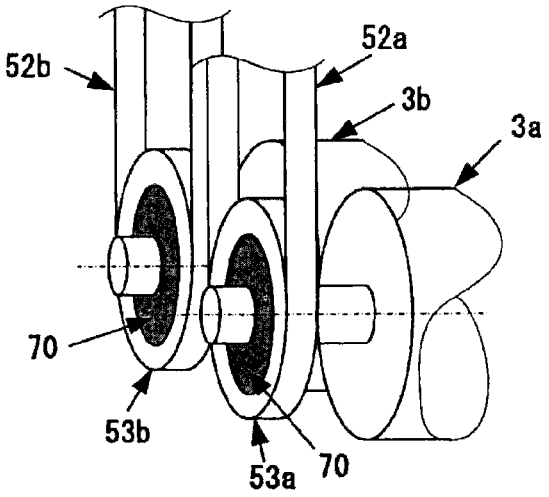
FIG. 21 is an enlarged perspective view showing a driving operation of a pressure roller constituted by conveying roller pair in the sheet folding apparatus according to embodiment 9.

FIG. 21 is an enlarged perspective view showing a driving operation of the pressure roller constituted by the conveying roller pair 3 in the sheet folding apparatus 1, according to embodiment 9. The driving system of the conveying roller pair 3, the first folding roller pair 6, and the second folding roller pair 7 is shown in FIG. 19.

Two torque limiters 70 are attached with a driving shaft in the pulley 53*a* for driving a pressing roller and another driving shaft in the pulley 53*b* for driving a conveying roller respectively.

A rotary driving force with more torque than a torque set in the torque limiters 70 isn't transmitted from the pulley 53*a* for driving a pressing roller and the pulley 53*b* for driving a conveying roller to the pressing roller 3*a* and the conveying roller 3*b*, respectively.

Torque limiters 70 are attached with a driving shaft in one lowering the conveying force among the conveying roller pair 3, the first folding roller pair 6 and the second folding roller pair 7. Therefore, a conveying force gap between the conveying roller pair 3 and the first folding roller pair 6 or the second folding roller pair 7 is caused. At that time, the torque limiter 70 is able to absorb the gap of the conveying speeds regardless of slack of the sheet P1 or the sheet P2. Therefore, the displacement of the folded sheet is prevented without damaging the sheet with slip between the sheet P and the conveying roller pair 3 or the first folding roller pair 6 or the second folding roller pair 7.

Figure 22:
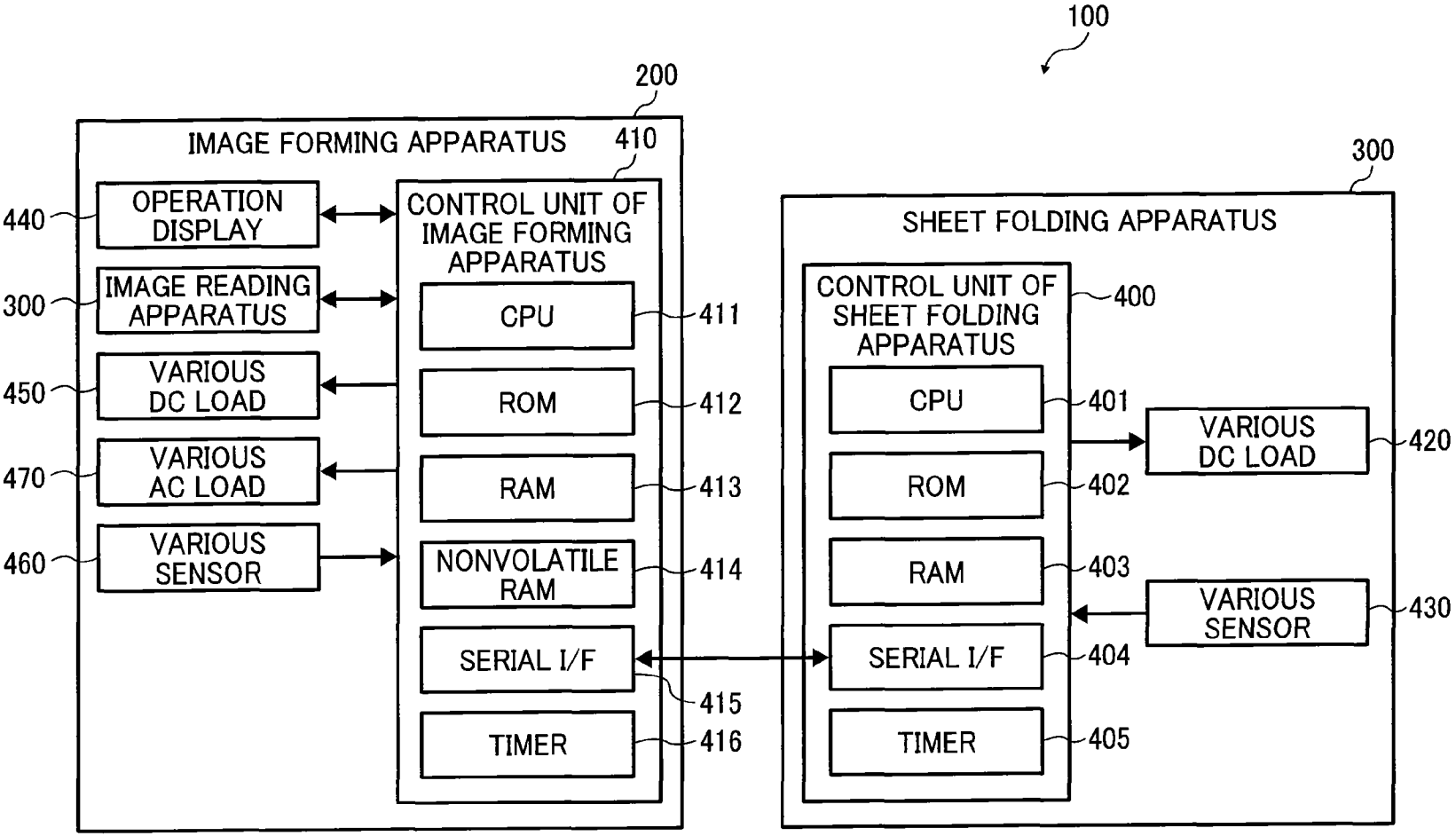
FIG. 22 is a block diagram showing a control configuration of an image forming system which shows the present invention including embodiment 1-8.

On the other hand, FIG. 22 is a block diagram showing a control configuration of an image forming system which shows the present application including embodiments 1-8.

A control unit 400 of a sheet folding apparatus includes CPU 401, ROM 402, RAM 403, SERIAL I/F 404 and TIMER 405, and controls the sheet folding apparatus 300.

The image forming apparatus 200 and the sheet folding apparatus 300 transmit and receive commands to control for conveying a sheet and folding a sheet through SERIAL I/F 415 and 404. A CPU 401 of the sheet folding apparatus 300 conducts various controls which include for a sheet folding processing with the conveying roller pair 3, the first folding roller pair 6, the second folding roller pair 7, the first sheet guiding member 4 and the second sheet guiding member 5, and for causing the gap of the sheet conveying speed or the sheet conveying amount between the conveying roller pair 3 and the first folding roller pair 6 or the second folding roller pair 7.

The invention claimed is:

1. A sheet folding apparatus, comprising:

a conveying roller pair that conveys a sheet;

a first folding roller pair that folds the sheet conveyed from the conveying roller pair;

a second folding roller pair that folds the sheet conveyed from the conveying roller pair in conjunction with the first folding roller pair, the second folding roller pair being arranged opposite to the first folding roller pair such that there is a predetermined gap therebetween; and a control circuit configured to control conveying the sheet with the conveying roller pair and to control folding the sheet with the first folding roller pair and the second folding roller pair, wherein the control circuit controls the apparatus so that a sheet conveying speed or a sheet conveying amount of the conveying roller pair is different from a sheet conveying speed or a sheet conveying amount of the first folding roller pair or the second folding roller pair when a folded part of a folded sheet is guided between the first folding roller pair and the second folding roller pair;

the control circuit controls the apparatus such that a sheet conveying force of the conveying roller pair is different from a sheet conveying force of the first folding roller pair or the second folding roller pair; and the control circuit controls when the sheet is conveyed from the first folding roller pair or the second folding roller pair to the conveying roller pair.

2. The sheet folding apparatus as claimed in claim 1, wherein the control circuit controls the apparatus such that the sheet conveying speed or the sheet conveying amount of the conveying roller pair is larger than the sheet conveying speed or the sheet conveying amount of the first folding roller pair or the second folding roller pair.

3. The sheet folding apparatus as claimed in claim 2, wherein the control circuit is configured to stop operation of the first folding roller pair and the second folding roller pair.

4. The sheet folding apparatus as claimed in claim 2, wherein the control circuit controls when a tip of the sheet enters in the conveying roller pair.

5. The sheet folding apparatus as claimed in claim 1, wherein the control circuit controls the apparatus such that a pressing force of the conveying roller pair is different from a pressing force of the first folding roller pair or the second folding roller pair.

6. The sheet folding apparatus as claimed in claim 1, further comprising a torque limiter attached with a driving shaft to lower the sheet conveying force among the conveying roller pair, the first folding roller pair, and the second folding roller pair, such that the conveying force gap between the conveying roller pair and the first folding roller pair or the second folding roller pair occurs.

7. The sheet folding apparatus as claimed in claim 1, further comprising a drive system of the conveying roller pair, the first folding roller pair, and the second folding roller pair, the drive system driving both a roller and a counter roller among the conveying roller pair, the first folding roller pair, and the second folding roller pair.

8. An image forming apparatus having an image forming unit which forms an image onto a sheet, comprising the sheet folding apparatus as claimed in claim 1.

* * * * *